US011675378B2

(12) United States Patent
Fronczak

(10) Patent No.: US 11,675,378 B2
(45) Date of Patent: Jun. 13, 2023

(54) LOW-DROPOUT REGULATOR ARCHITECTURE WITH UNDERSHOOT MITIGATION

(71) Applicant: Sony Semiconductor Solutions Corporation, Kanagawa (JP)

(72) Inventor: Kevin Fronczak, Rochester, NY (US)

(73) Assignee: Sony Semiconductor Solutions Corporation, Kanagawa (JP)

( * ) Notice: Subject to any disclaimer, the term of this patent is extended or adjusted under 35 U.S.C. 154(b) by 0 days.

(21) Appl. No.: 17/020,116

(22) Filed: Sep. 14, 2020

(65) Prior Publication Data

US 2022/0083086 A1 Mar. 17, 2022

(51) Int. Cl.
*G05F 1/46* (2006.01)
*G05F 1/575* (2006.01)

(52) U.S. Cl.
CPC ..... *G05F 1/575* (2013.01)

(58) Field of Classification Search
None
See application file for complete search history.

(56) References Cited

U.S. PATENT DOCUMENTS 6,900,621 B1 * 5/2005 Gunther ..... G05F 1/573 323/266
8,754,628 B2 * 6/2014 Namai ..... G05F 1/56 323/311
8,917,069 B2 * 12/2014 Howes ..... G05F 1/575 323/266
9,122,289 B2 * 9/2015 Howes ..... G05F 1/46
9,122,292 B2 * 9/2015 Pan ..... G05F 1/575
9,939,831 B2 * 4/2018 Verma ..... G05F 1/575
10,025,334 B1 * 7/2018 Derman ..... G05F 1/575
10,496,115 B2 * 12/2019 Hung ..... G05F 1/575
10,782,719 B2 * 9/2020 Kim ..... G05F 1/462
2004/0164789 A1 8/2004 Leung et al.
2009/0195290 A1 8/2009 Moraveji
2011/0018507 A1 1/2011 McCloy-Stevens et al.
2011/0057825 A1 3/2011 Marraccini et al.
2012/0086420 A1 4/2012 Simmons et al.
2014/0266103 A1 * 9/2014 Wang ..... G05F 1/565 323/275
2019/0212762 A1 * 7/2019 Heo ..... G05F 1/575
2019/0243403 A1 8/2019 Gebeyehu et al.
2021/0263544 A1 * 8/2021 Kadanka ..... G05F 1/613

OTHER PUBLICATIONS

International Search Report & Written Opinion dated Sep. 28, 2021 for corresponding International Application No. PCT/US2021/39360.

* cited by examiner

*Primary Examiner* — Thomas J. Hiltunen
(74) *Attorney, Agent, or Firm* — Michael Best & Friedrich LLP

(57) ABSTRACT

A low-dropout regulator architecture with undershoot mitigation. In one embodiment, a system including a low-dropout regulator and a digital-to-analog converter (DAC). The low-dropout regulator is configured to generate a load current and output a voltage at an output node. The digital-to-analog converter (DAC) is configured to receive a control input, and output a DAC current to the low-dropout regulator based on the control input. The DAC current is configured to modify the load current and mitigate an undershoot of the voltage that is output at the output node while the voltage transitions from a high voltage level to a low voltage level.

13 Claims, 6 Drawing Sheets

LOW-DROPOUT REGULATOR ARCHITECTURE WITH UNDERSHOOT MITIGATION

BACKGROUND OF THE INVENTION

1. Field of the Invention

This application relates generally to voltage regulators. More specifically, this application relates to a low-dropout (LDO) regulator architecture with undershoot mitigation in low-power integrated circuits.

2. Description of Related Art

For low-power Dynamic Voltage Scaling (DVS) systems, on-chip LDOs are required to achieve high-performance and low power consumption. However, when transitioning from a high-voltage to a low-voltage during a DVS event, a comparative LDO may undershoot a target voltage. This undershoot may cause the voltage to drop below a minimum threshold required for digital circuits, such as SRAM, and dropping below the minimum threshold may cause undesired behavior in the digital circuits. This undershoot is a function of both LDO load current and LDO output capacitance. The worst undershoot occurs at a specific combination of load current and output capacitances. Comparative DVS systems employ multiple on-chip LDOs and use "capacitorless" LDOs to save on external component cost. The comparative DVS systems are designed to tolerate single digit to tens of nano-Farads (nF) of on-chip capacitance, which is a critical point where startup undershoot becomes an issue.

BRIEF SUMMARY OF THE INVENTION

Various aspects of the present disclosure relate to LDO architecture with undershoot mitigation (also referred to herein as "undershoot mitigation LDO architecture"). In one aspect of the present disclosure, a system is provided. The system includes a low-dropout regulator and a digital-to-analog converter (DAC). The low-dropout regulator is configured to generate a load current and output a voltage at an output node. The digital-to-analog converter is configured to receive a control input, and output a DAC current to the low-dropout regulator based on the control input. The DAC current is configured to modify the load current and mitigate an undershoot of the voltage that is output at the output node while the voltage transitions from a high voltage level to a low voltage level.

In another aspect of the present disclosure, a method is provided. The method includes receiving, with a digital-to-analog converter, a control input. The method also includes outputting, with the DAC, a DAC current to a low-dropout regulator based on the control input, wherein the DAC current modifies a load current generated by the low-dropout regulator and mitigates an undershoot of a voltage that is output at an output node of the low-dropout regulator while the voltage transitions from a high voltage level to a low voltage level.

In yet another aspect of the present disclosure, a non-transitory computer-readable medium is provided. The non-transitory computer-readable medium comprises instructions that, when executed by an electronic processor, cause the electronic processor to perform a set of operations. The set of operations includes determining when a voltage that is output at an output node of a low-dropout regulator transitions from a high voltage level to a low voltage level. The set of operations also includes controlling a digital-to-analog converter to output a DAC current to a low-dropout regulator, wherein the DAC current modifies a load current generated by the low-dropout regulator and mitigates an undershoot of the voltage that is output at the output node of the low-dropout regulator while the voltage transitions from the high voltage level to the low voltage level.

In this manner, the above aspects of the present disclosure provide for improvements in at least the technical field of object feature detection, as well as the related technical fields of imaging, image processing, and the like.

This disclosure can be embodied in various forms, including hardware or circuits controlled by computer-implemented methods, computer program products, computer systems and networks, user interfaces, and application programming interfaces; as well as hardware-implemented methods, signal processing circuits, image sensor circuits, application specific integrated circuits, field programmable gate arrays, and the like. The foregoing summary is intended solely to give a general idea of various aspects of the present disclosure, and does not limit the scope of the disclosure in any way.

DESCRIPTION OF THE DRAWINGS

These and other more detailed and specific features of various embodiments are more fully disclosed in the following description, reference being had to the accompanying drawings, in which.

DETAILED DESCRIPTION

In the following description, numerous details are set forth, such as flowcharts, data tables, and system configurations. It will be readily apparent to one skilled in the art that these specific details are merely exemplary and not intended to limit the scope of this application.

Figure 1:
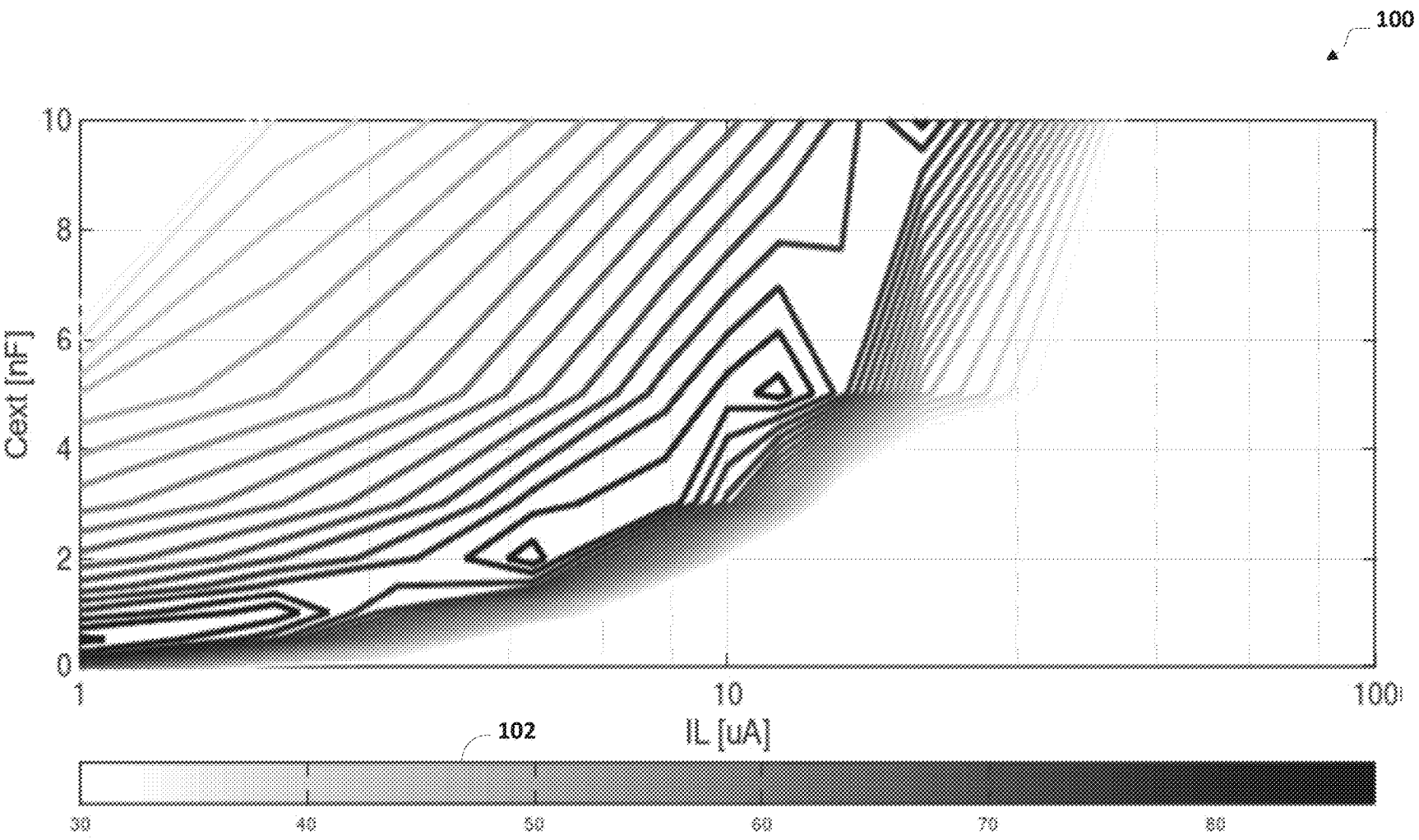
FIG. 1 is a diagram illustrating voltage undershoot as a function of a load current and an external capacitance for a comparative LDO architecture.

FIG. 1 is a diagram 100 illustrating voltage undershoot as a function of a load current and an external capacitance for a comparative LDO architecture. In the example of FIG. 1, the voltage undershoot is a two-dimensional representation, where the load current is microamperes on the X-axis and the external capacitance is nano-Farads on the Y-axis. The line 102 represents an amount of undershoot in units of millivolts (mV).

Figure 2:
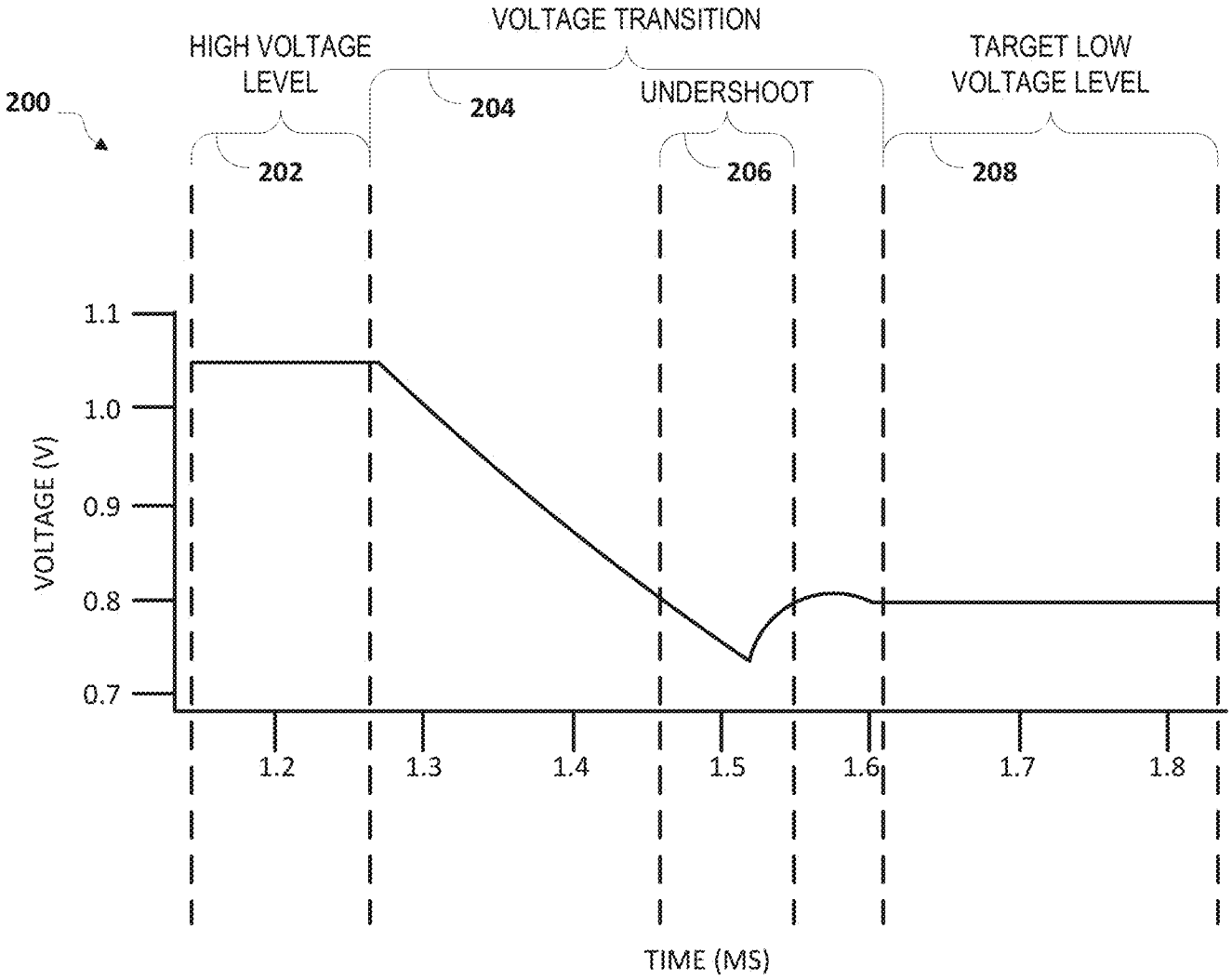
FIG. 2 is a diagram illustrating an LDO undershoot for a comparative LDO architecture during a transition.

FIG. 2 is a diagram 200 illustrating an LDO undershoot for a comparative LDO architecture during a transition. In the example of FIG. 2, the diagram 200 includes a high voltage level period 202, a voltage transition period 204, an undershoot period 206, and a target low voltage level period 208.

As illustrated in FIG. 2, during the voltage transition period 204, the voltage regulated by the comparative LDO architecture transitions from approximately 1060 mV at approximately 1.275 milliseconds (ms) to approximately 799 mV at approximately 1.6 ms, where the target voltage level is 800 mV. However, during this transition, the voltage regulated by the comparative LDO architecture drops to approximately 737 mV at approximately 1.525 ms before rising up and settling at approximately 799 mV at approximately 1.6 ms, which is the undershoot period 206. In other words, the drop to approximately 737 mV at approximately 1.525 ms before rising up and settling at approximately 799 mV at approximately 1.6 ms represents an approximate 61 mV undershoot by the comparative LDO architecture. Further, the comparative LDO architecture transitions from approximately 1060 mV to the target of 800 mV in approximately 0.325 ms.

Figure 3:
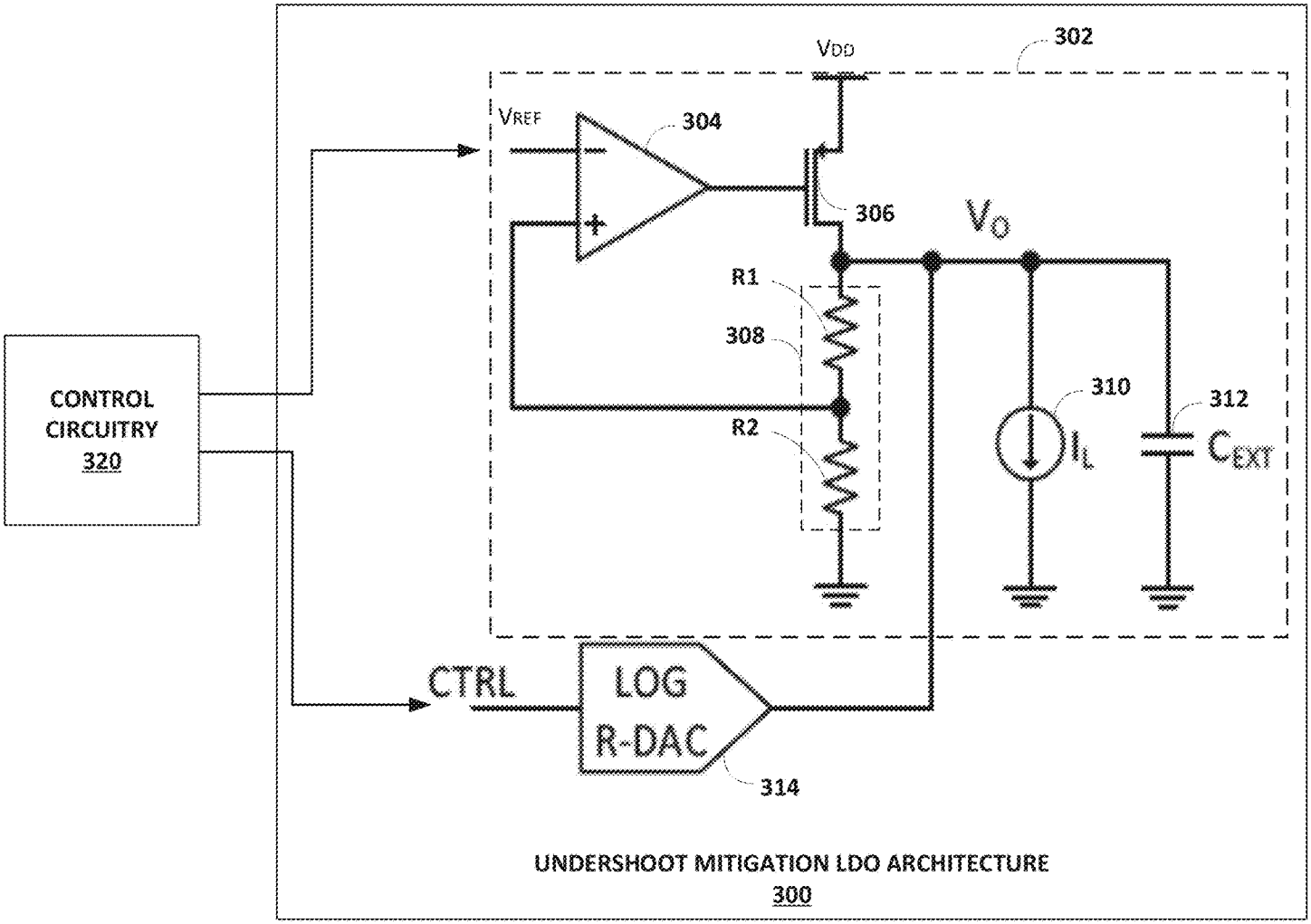
FIG. 3 is a diagram illustrating an undershoot mitigation LDO architecture and a control circuitry according to various aspects of the present disclosure.

FIG. 3 is a diagram illustrating an undershoot mitigation LDO architecture 300 and a control circuitry 320 according to various aspects of the present disclosure. In the example of FIG. 3, the undershoot mitigation LDO architecture 300 includes a low-dropout (LDO) regulator 302 and a Logarithmic Resistive Digital-to-Analog Converter (LOG R-DAC) 314. The LDO regulator 302 includes a differential amplifier 304, a transistor 306, a voltage divider 308 formed by a first resistor R1 and a second resistor R2, a load current source 310, and an external capacitor 312. In some examples, the control circuitry 320 may be an electronic processor (e.g., a microprocessor or other suitable processing circuitry) that executes digital control logic performing some or all of the functions described below with respect to FIGS. 6 and 7. In other examples, the control circuitry 320 may be resistor-transistor logic (RTL) that executes a finite state machine (FSM) performing some or all of the functions described below with respect to FIGS. 6. and 7.

While the example of FIG. 3 illustrates the LOG R-DAC 314 and the control circuitry 320 as being separate and distinct electronic components, the present disclosure is not limited to the LOG R-DAC 314 and the control circuitry 320 as being separate and distinct electronic components. In some examples, the control circuitry 320 may be included in the undershoot mitigation LDO architecture 300. For example, the control circuitry 320 may be included in the LOG R-DAC 314.

As described in FIG. 1, the undershoot of an LDO transitioning from high to low voltage is a function of load current and capacitance. The undershoot mitigation LDO architecture 300 of FIG. 3 modifies the load current for any external capacitance of the external capacitor 312 with a DAC current from the LOG R-DAC 314 during the voltage transition to mitigate an undershoot a voltage that is output at the output node Vo. In some examples, the DAC current that modifies the load current is pulsed and does not impact system power, which is the primary goal of DVS systems. Additionally, the LOG R-DAC 314 is logarithmic in order to achieve both low and high currents (1-100×) in as little area as possible, while still having control over the value of the DAC current, and consequently, the load current IL.

However, the undershoot mitigation LDO architecture 300 is not limited to using the LOG R-DAC 314. Instead, the LOG R-DAC 314 is specific to the particular implementation of FIG. 3. The undershoot mitigation LDO architecture 300 may be any arbitrary DAC that generates an adjustable load current from digital code provided the DAC can operate at potentially sub-threshold supply voltages.

When the control circuitry 320 requests the undershoot mitigation LDO architecture 300 to take control of the output supply, the control circuitry 320 also enables the LOG R-DAC 314 with a certain adjust code corresponding to a nominal load current output. The LOG R-DAC 314 output is then delayed for a programmable number of clock cycles in order to: 1) allow the output of the undershoot mitigation LDO architecture 300 to begin regulation (assuming the undershoot mitigation LDO architecture 300 is starting from a non-regulation state) and 2) reduce duty-cycled power consumption to only enable the LOG R-DAC 314 when it is needed.

The control circuitry 320 may use at least one of two methods for determining the delay, dependent on system requirement. In one method, the control circuitry 320 may delay the DAC current from the LOG R-DAC 314 until the output of the undershoot mitigation LDO architecture 300 begins decreasing from its initial value. This delay of the DAC current allows for startup-time reduction for low-power LDOs by having the DAC current discharge the output capacitor.

In this instance, the ideal current generated by the LOG R-DAC 314 may be determined with the following expression:

$$I_{RDAC} = C_{EXT}\frac{V_{START} - V_{FINAL}}{t_{START}} \tag{1}$$

In the above expression, VSTART is the initial voltage of the undershoot mitigation LDO architecture 300, VFINAL is the desired target output voltage, tsTART is the desired transition time, and CEXT is the external capacitor 312 at the output of the undershoot mitigation LDO architecture 300. For example, if the external capacitor 312 has a capacitance of 10 nF with a 500 mV transition and a desired transition time of 1 microsecond (μs), the DAC current would need to be 5 milliamperes (mA).

Alternatively, instead of delaying the DAC current from the LOG R-DAC 314 until the output of the undershoot mitigation LDO architecture 300 begins decreasing from its initial value, the control circuitry 320 may delay the DAC current until slightly before the undershoot mitigation LDO architecture 300 reaches the target final value. The delay of the DAC current until slightly before the undershoot mitigation LDO architecture 300 reaches the target final value minimizes the time the LOG R-DAC 314 is enabled, which reduces overall system power. However, in the alternative method, the value of the DAC current becomes architecture-dependent and no universal calculation of ideal current is possible.

In some examples, the delay of the DAC current may be set after observing simulation and picking an ideal duration. In other examples, an additional circuit may be added to the undershoot mitigation LDO architecture 300 to sense the output of the undershoot mitigation LDO architecture 300 and enable the LOG R-DAC 314 based on the sensed output. The additional circuit is not illustrated or discussed in further detail in this disclosure because the additional circuit would require more power to implement, which is undesirable for low-power DVS systems. However, the additional circuit may be implemented with comparator based circuits.

In addition to the current value and delay, the duration of the current pulse of the DAC current is also programmable.

The programmability of a duration of the current pulse of the DAC current allows for flexibility to ensure that the undershoot mitigation LDO architecture 300 is stable prior to the disabling of the LOG R-DAC 314 by the control circuitry 320. In this type of implementation, the control circuitry 320 may keep the LOG R-DAC 314 active while digital activity occurs because the DAC current generated by the LOG R-DAC 314 is static and controllable by the control circuitry 320.

An additional feature of this implementation is the ability to have a soft-start and soft-stop function. The load current may be stepped logarithmically (for example, 10 microamperes (μA) to 100 uA to 1 mA) in order to minimize potential transient events seen at the output of the undershoot mitigation LDO architecture 300 when enabled. When disabled, the same sequence may occur in reverse order, to ensure switching from a high current to low current does not impact the output voltage of the undershoot mitigation LDO architecture 300 and, potentially, corrupt the control circuitry 320.

Figure 4:
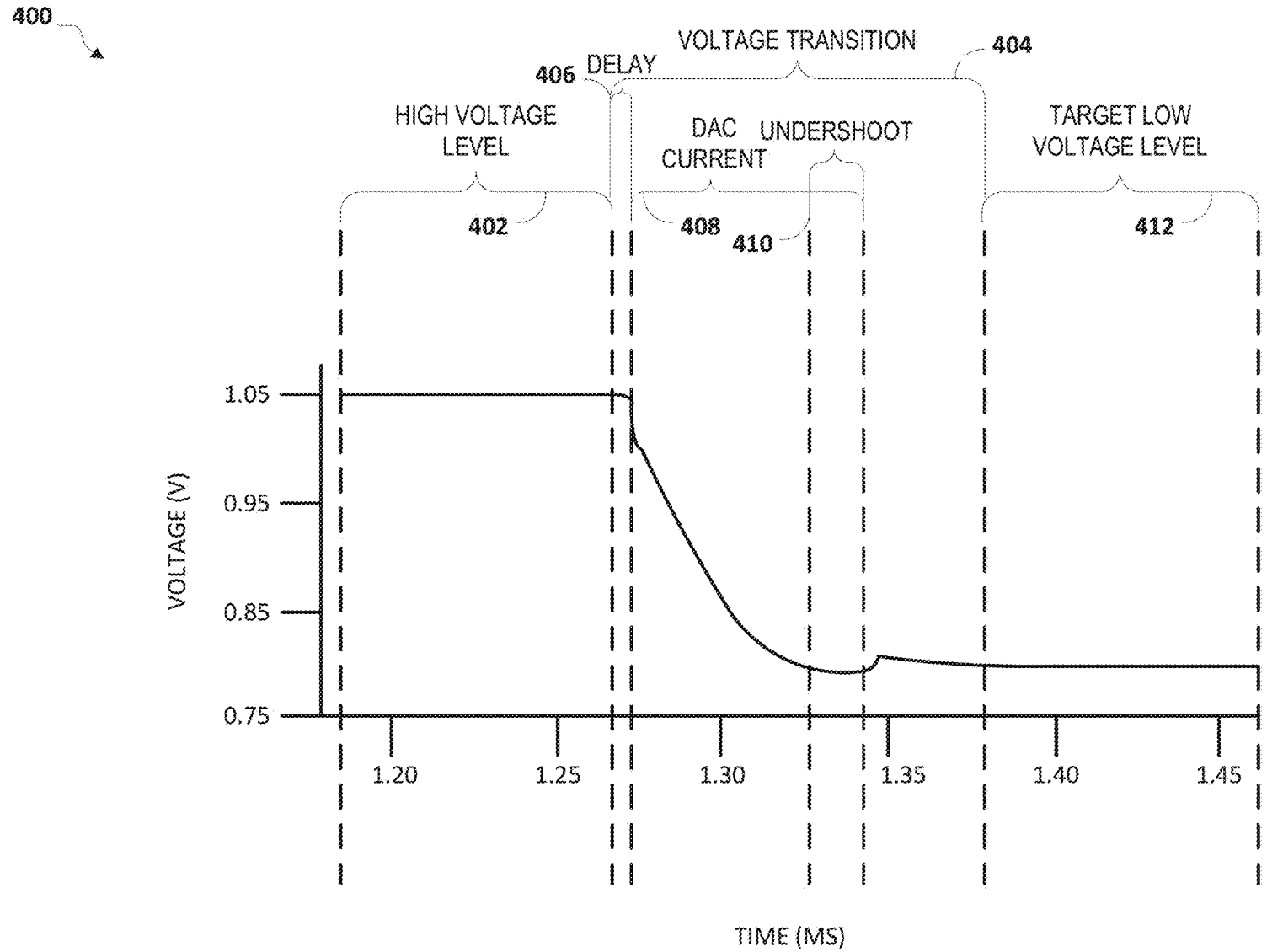
FIG. 4 is a diagram illustrating a mitigated LDO undershoot for the undershoot mitigation LDO architecture of FIG. 3 according to various aspects of the present disclosure.

FIG. 4 is a diagram 400 illustrating a mitigated LDO undershoot for the undershoot mitigation LDO architecture 300 of FIG. 3 according to various aspects of the present disclosure. In the example of FIG. 4, the diagram 400 includes a high voltage level period 402, a voltage transition period 404, a delay period 406, a DAC current period 408, an undershoot period 410, and a target low voltage level period 412.

As illustrated in FIG. 4, during the voltage transition period 404, the voltage regulated by the undershoot mitigation LDO architecture 300 transitions from approximately 1060 mV at approximately 1.275 ms to approximately 798 mV at approximately 1.38 ms, where the target low voltage level is 800 mV.

During this transition, the delay period 406 is a period where the load current is uncontrolled and not modified by any other currents. After the delay period 406, the LOG R-DAC 314 begins providing the DAC current to the LDO regulator 302 during the DAC current period 408. While the delay period 406 in FIG. 4 is only a short period of time after the output voltage of the LDO regulator 302 begins to decrease, the delay period 406 may be extended to adjacent or nearly adjacent to the undershoot period 410. When the delay period 406 is extended to be adjacent to or nearly adjacent to the undershoot period 410, then the DAC current period 408 is substantially similar to the undershoot period 410 as explained above in FIG. 3.

During the DAC current period 408, the voltage regulated by the undershoot mitigation LDO architecture 300 drops to approximately 794 mV at approximately 1.34 ms before rising up and settling at approximately 798 mV at approximately 1.38 ms, which is the undershoot period 410. In other words, the drop to approximately 794 mV at approximately 1.34 ms before rising up and settling at approximately 798 mV at approximately 1.38 ms represents an approximate 4 mV undershoot by the undershoot mitigation LDO architecture 300. Further, the undershoot mitigation LDO architecture 300 transitions from approximately 1060 mV to the target of 800 mV in approximately 0.1 ms.

In the example of FIG. 4, the undershoot mitigation LDO architecture 300 mitigates the undershoot by 57 mV or 99.34% when compared to the undershoot of the comparative LDO architecture as illustrated in FIG. 2. Similarly, in the example of FIG. 4, the undershoot mitigation LDO architecture 300 reduces the voltage transition time by 0.25 ms or 69.23% when compared to the voltage transition time of the comparative LDO architecture as illustrated in FIG. 2.

Figure 5:
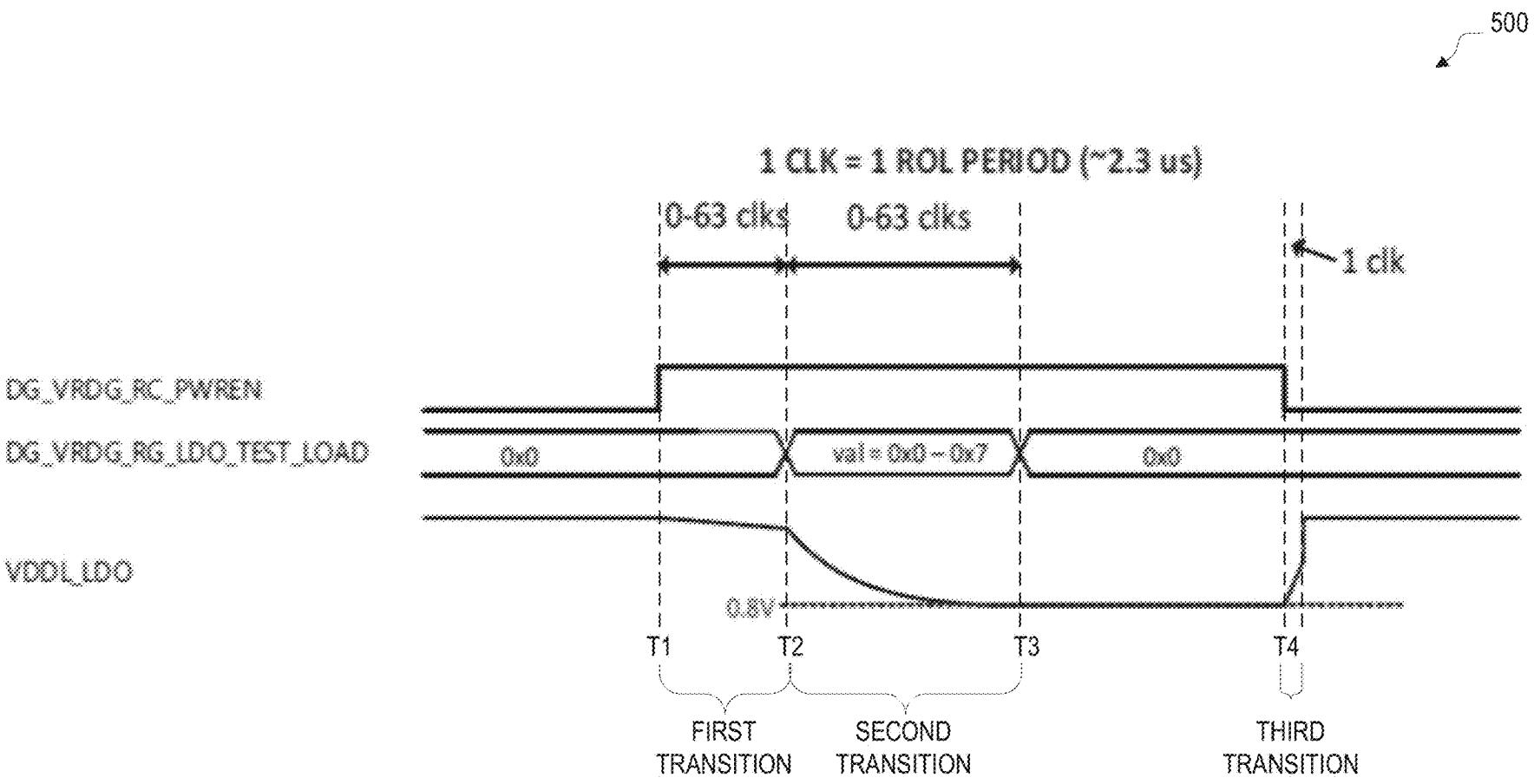
FIG. 5 is an example timing diagram of the undershoot mitigation LDO architecture of FIG. 3 according to various aspects of the present disclosure.

FIG. 5 is an example timing diagram 500 of the undershoot mitigation LDO architecture 300 of FIG. 3 according to various aspects of the present disclosure. In the example of FIG. 5, the timing diagram 500 includes a DG_VRDG_RC_PWREN signal 502, a DG_VRDG_RG_LDO_TEST_LOAD signal 504, and VDDL_LDO signal 506. The DG_VRDG_RC_PWREN signal 502 is an enable signal that initiates regulation by the undershoot mitigation LDO architecture 300. The DG_VRDG_RG_LDO_TEST_LOAD signal 504 is a control input to the LOG R-DAC 314. The VDDL_LDO signal 506 is the output of the undershoot mitigation LDO architecture 300.

As illustrated in FIG. 5, at time T1, the DG_VRDG_RC_PWREN signal 502 enables the LDO architecture 300 and causes the VDDL_LDO signal 506 to begin a first transition from a high voltage (i.e., VDD) to a target voltage. In some examples, the first transition may be a period of zero and sixty-three clock pulses, where each clock pulse is approximately 2.3 microseconds (μs). In other examples, the first transition may be a period that is programmable to N number of clock pulses, where each clock pulse is approximately 2.3 microseconds (μs).

At time T2, the control circuitry 320 outputs the DG_VRDG_RG_LDO_TEST_LOAD signal 504 to control the LOG R-DAC 314 and causes the VDDL_LDO signal 506 to begin a second transition to the target voltage (e.g., the target voltage is 0.8V). This second transition in the VDDL_LDO signal 506 is different from the first transition and the result of the DAC current of the LOG R-DAC 314 modifying the load current as described above.

In some examples, the DG_VRDG_RG_LDO_TEST_LOAD signal 504 may be a value between zero and seven (i.e., 0x0-0x7). For example, the DG_VRDG_RG_LDO_TEST_LOAD signal 504 may be a value of 0x7 to control the LOG R-DAC 314 to output a maximum amount of the load current as described above.

In some examples, the second transition may be a period of zero and sixty-three clock pulses, where each clock pulse is approximately 2.3 microseconds (μs). In other examples, the second transition may be a period that is programmable to N number of clock pulses, where each clock pulse is approximately 2.3 microseconds (μs).

At time T3, the VDDL_LDO signal 506 reaches the target voltage and the control circuitry 320 disables the LOG R-DAC 314 with the DG_VRDG_RG_LDO_TEST_LOAD signal 504. For example, the DG_VRDG_RC_PWREN signal 502 may be a value of 0x0 to control the LOG R-DAC 314 to stop the output of the load current as described above.

Lastly, at time T4, the DG_VRDG_RC_PWREN signal 502 disables the LDO architecture 300 and causes the VDDL_LDO signal 506 to begin a third transition from the target voltage (e.g., 0.8V) to the high voltage (i.e., VDD). In some examples, the third transition may be between one clock pulse, where a clock pulse is approximately 2.3 μs.

Figure 6:
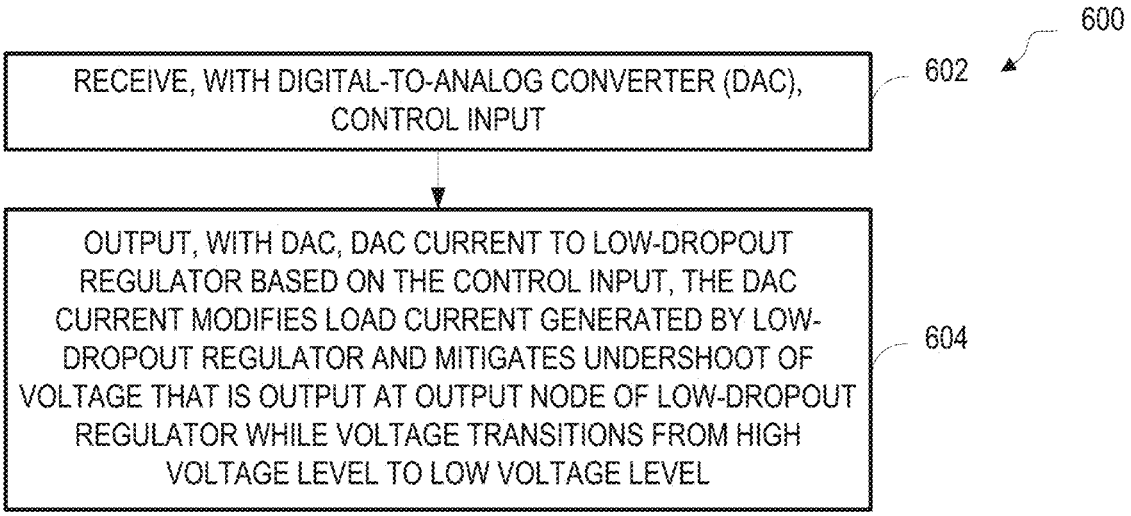
FIG. 6 is a flowchart illustrating a method for operating a digital-to-analog converter according to various aspects of the present disclosure.

FIG. 6 is a flowchart illustrating a method 600 for operating a digital-to-analog converter according to various aspects of the present disclosure. The method 600 is also described with respect to the LOG R-DAC 314 of FIG. 3, however, the method 600 is not limited to the LOG R-DAC 314 of FIG. 3. The method 600 may be implemented by other suitable digital-to-analog converters.

As illustrated in FIG. 6, the method 600 includes receiving, with a digital-to-analog converter, a control input (at block 602). For example, the method 600 includes receiving, with the LOG R-DAC 314, a control input.

The method 600 also includes outputting, with the DAC, a DAC current to the low-dropout regulator based on the control input, the DAC current modifies a load current generated by the low-dropout regulator and mitigates an undershoot of a voltage that is output at an output node of the low-dropout regulator while the voltage transitions from a high voltage level to a low voltage level (at block 604). For example, the method 600 also includes outputting, with the LOG R-DAC 314, a DAC current to the low-dropout regulator 302 based on the control input, the DAC current modifies a load current generated by the low-dropout regulator 302 and mitigates an undershoot of a voltage that is output at an output node Vo of the low-dropout regulator 302 while the voltage transitions from a high voltage level to a low voltage level In some examples, the method 600 may further include the LOG R-DAC 314 outputting the DAC current with current pulses based on the control input. In these examples, the current pulses may step the load current generated by the load current source 310 from 10 μA to 1 mA.

Figure 7:
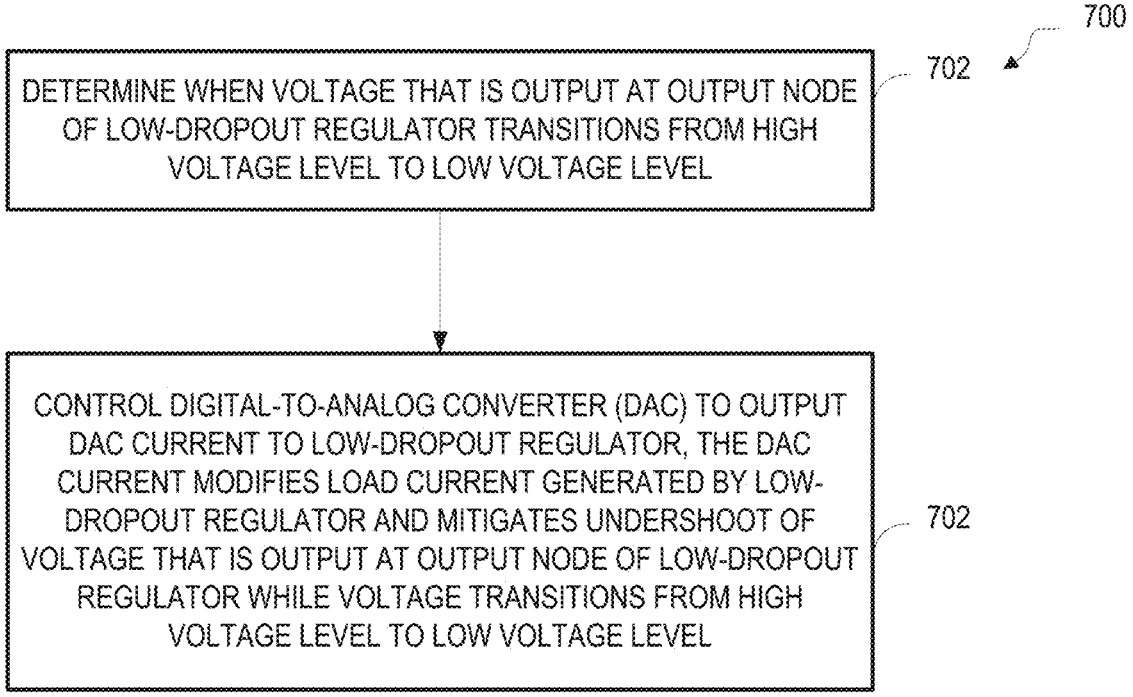
FIG. 7 is a flowchart illustrating a method for operating a control circuitry according to various aspects of the present disclosure.

FIG. 7 is a flowchart illustrating a method 700 for operating a control circuitry according to various aspects of the present disclosure. FIG. 7 is described with reference to the control circuitry 320 of FIG. 3, however, FIG. 7 is not limited to the control circuitry 320 of FIG. 3. For example, the method 700 may also be implemented by other suitable electronic processing devices executing instructions that are stored either locally or remotely on a non-transitory computer readable medium. The instructions being defined by the method 700 as described below.

As illustrated in FIG. 7, the method 700 includes determining when a voltage that is output at an output node of a low-dropout regulator transitions from a high voltage level to a low voltage level (at block 702). For example, the control circuitry 320 determines when a voltage that is output at an output node Vo of the low-dropout regulator 302 transitions from a high voltage level to a low voltage level.

As illustrated in FIG. 7, the method 700 also includes controlling a digital-to-analog converter to output a DAC current to a low-dropout regulator, the DAC current modifies a load current generated by the low-dropout regulator and mitigates an undershoot of the voltage that is output at the output node of the low-dropout regulator while the voltage transitions from the high voltage level to the low voltage level (at block 704). For example, the control circuitry 320 controls the LOG R-DAC 314 to output a DAC current to the low-dropout regulator 302, the DAC current modifies a load current generated by the low-dropout regulator 302 and mitigates an undershoot of the voltage that is output at the output node Vo of the low-dropout regulator 302 while the voltage transitions from the high voltage level to the low voltage level.

In some examples, the method 700 may further include the control circuitry 320 determining when an amount of time from a start of the voltage transition reaches a predetermined temporal threshold, and the control circuitry 320 controlling the DAC to output the DAC current in response to determining that the amount of time from the start of the voltage transition reaches the predetermined temporal threshold.

In the above examples, the method 700 may further include the control circuitry 320 retrieving an estimated amount of time from the start of the voltage transition to a beginning of a decrease in the voltage that is output, and the control circuitry 320 setting the estimated amount of time as the predetermined temporal threshold.

Alternatively, in the above examples, the method 700 may further include the control circuitry 320 retrieving an estimated amount of time from the start of the voltage transition to just before an end of the voltage transition, and the control circuitry 320 setting the estimated amount of time as the predetermined temporal threshold.

In some examples, the method 700 may further include the control circuitry 320 receiving an input indicative of a beginning of a decrease in the voltage that is output when the voltage transitions from the high voltage level to the low voltage level, and the control circuitry 320 outputting the control input to the DAC in response to receiving the input indicative of the beginning of the decrease in the voltage that is output when the voltage transitions from the high voltage level to the low voltage level.

In some examples, the method 700 may further include the control circuitry 320 receiving an input indicative of a beginning of the undershoot in the voltage that is output when the voltage transitions from the high voltage level to the low voltage level, and the control circuitry 320 outputting the control input to the DAC in response to receiving the input indicative of a beginning of the undershoot in the voltage that is output when the voltage transitions from the high voltage level to the low voltage level.

The undershoot mitigation LDO architecture as described above includes several advantages over the comparative on-chip LDOs. First, the undershoot mitigation LDO architecture of the disclosure provides a controlled current via logarithmic resistive digital-to-analog converter to a low-dropout regulator. Second, the undershoot mitigation LDO architecture of the disclosure is operational at sub-$V_{TH}$ voltages. Third, the undershoot mitigation LDO architecture of the disclosure provides an adjustable current pulse start and duration. Fourth, the undershoot mitigation LDO architecture of the disclosure allows for approximately 100× scaling of current for different LDO architectures. Fifth, the undershoot mitigation LDO architecture of the disclosure allows for soft-start/stop to minimize load step transients.

Comparatively, the comparative on-chip LDOs provide an uncontrolled current via digital signaling. Additionally, for DVS systems where voltage can be low (less than nominal $V_{TH}$), gate voltage on a pull-down transistor may not be high enough to provide enough of a simulated load for the comparative on-chip LDOs to remain operation.

The following are enumerated examples of the systems, methods, and non-transitory computer-readable medium with respect to the low-dropout (LDO) regulator architecture with undershoot mitigation in low-power integrated circuits of the present disclosure. However, the enumerated examples represent only a subset of all available example systems, methods, and non-transitory computer-readable medium with respect to the low-dropout (LDO) regulator architecture with undershoot mitigation in low-power integrated circuits of the present disclosure. Consequently, the present disclosure is not limited to the enumerated examples set forth below.

Example 1: A system comprising: a low-dropout regulator configured to generate a load current and output a voltage at an output node; and a digital-to-analog converter (DAC) configured to receive a control input, and output a DAC current to the low-dropout regulator based on the control input, wherein the DAC current is configured to modify the load current and mitigate an undershoot of the voltage that is output at the output node while the voltage transitions from a high voltage level to a low voltage level.

Example 2: The system according to Example 1, further comprising: control circuitry configured to determine when the voltage transitions from the high voltage level to the low voltage level, determine when an amount of time from a start of the voltage transition reaches a predetermined temporal threshold in response to determining that the voltage is transitioning from the high voltage level to the low voltage level, and output the control input to the DAC in response to determining that the amount of time from the start of the voltage transition reaches the predetermined temporal threshold.

Example 3: The system according to Example 2, wherein the control circuitry is further configured to retrieve an estimated amount of time from the start of the voltage transition to a beginning of a decrease in the voltage that is output, and set the estimated amount of time as the predetermined temporal threshold.

Example 4: The system according to Example 2, wherein the control circuitry is further configured to retrieve an estimated amount of time from the start of the voltage transition to just before an end of the voltage transition, and set the estimated amount of time as the predetermined temporal threshold.

Example 5: The system according to any of Examples 1-4, further comprising: control circuitry configured to receive an input indicative of a beginning of a decrease in the voltage that is output when the voltage transitions from the high voltage level to the low voltage level, and output the control input to the DAC in response to receiving the input indicative of the beginning of the decrease in the voltage that is output when the voltage transitions from the high voltage level to the low voltage level.

Example 6: The system according to any of Examples 1-5, further comprising: control circuitry configured to receive an input indicative of a beginning of the undershoot in the voltage that is output when the voltage transitions from the high voltage level to the low voltage level, and output the control input to the DAC in response to receiving the input indicative of a beginning of the undershoot in the voltage that is output when the voltage transitions from the high voltage level to the low voltage level.

Example 7: The system according to any of Examples 1-6, wherein the DAC is a logarithmic resistive digital-to-analog converter.

Example 8: The system according to Example 7, wherein, to output the DAC current based on the control input, the logarithmic resistive digital-to-analog converter is configured to output the DAC current with current pulses based on the control input.

Example 9: The system according to Example 8, wherein the DAC current is configured to modify the output of the load current to mitigate the undershoot of the voltage at the output node further includes the current pulses stepping the load current from 10 microamperes (μA) to 1 milliampere (mA).

Example 10: The system according to any of Examples 1-9, wherein the low-dropout regulator further includes a transistor, a differential amplifier including a reference input, a feedback input, and an output that is electrically connected to a gate of the transistor, a voltage divider including a first resistor, a second resistor, and a feedback node between the first resistor and the second resistor that is electrically connected to the feedback input, a load current source configured to generate the load current, and an external capacitor, wherein the transistor and the first resistor are electrically connected directly to a first node, wherein the load current source and the external capacitor are electrically connected directly to the output node, and wherein the DAC is electrically connected directly to a second node that is between and electrically connected to the first node and the output node.

Example 11: A method comprising: receiving, with a digital-to-analog converter (DAC), a control input; and outputting, with the DAC, a DAC current to a low-dropout regulator based on the control input, wherein the DAC current modifies a load current generated by the low-dropout regulator and mitigates an undershoot of a voltage that is output at an output node of the low-dropout regulator while the voltage transitions from a high voltage level to a low voltage level.

Example 12: The method according to Example 11, further comprising: determining when the voltage transitions from the high voltage level to the low voltage level; determining when an amount of time from a start of the voltage transition reaches a predetermined temporal threshold in response to determining that the voltage is transitioning from the high voltage level to the low voltage level; and outputting the control input to the DAC in response to determining that the amount of time from the start of the voltage transition reaches the predetermined temporal threshold.

Example 13: The method according to Example 12, further comprising: retrieving an estimated amount of time from the start of the voltage transition to a beginning of a decrease in the voltage that is output; and setting the estimated amount of time as the predetermined temporal threshold.

Example 14: The method according to Example 12, further comprising: retrieving an estimated amount of time from the start of the voltage transition to just before an end of the voltage transition; and setting the estimated amount of time as the predetermined temporal threshold.

Example 15: The method according to any of Examples 11-14, further comprising: receiving an input indicative of a beginning of a decrease in the voltage that is output when the voltage transitions from the high voltage level to the low voltage level; and outputting the control input to the DAC in response to receiving the input indicative of the beginning of the decrease in the voltage that is output when the voltage transitions from the high voltage level to the low voltage level.

Example 16: The method according to any of Examples 11-15, further comprising: receiving an input indicative of a beginning of the undershoot in the voltage that is output when the voltage transitions from the high voltage level to the low voltage level; and outputting the control input to the DAC in response to receiving the input indicative of a beginning of the undershoot in the voltage that is output when the voltage transitions from the high voltage level to the low voltage level.

Example 17: The method according to any of Examples 11-16, wherein outputting the DAC current based on the control input further includes outputting the DAC current with current pulses based on the control input.

Example 18: A non-transitory computer-readable medium comprising instructions that, when executed by an electronic processor, cause the electronic processor to perform a set of operations comprising: determining when a voltage that is output at an output node of a low-dropout regulator transitions from a high voltage level to a low voltage level; and controlling a digital-to-analog converter (DAC) to output a DAC current to a low-dropout regulator, wherein the DAC current modifies a load current generated by the low-dropout regulator and mitigates an undershoot of the voltage that is output at the output node of the low-dropout regulator while the voltage transitions from the high voltage level to the low voltage level.

Example 19: The non-transitory computer-readable medium according to Example 18, wherein the set of operations further includes determining when an amount of time from a start of the voltage transition reaches a predetermined temporal threshold; and controlling the DAC to output the DAC current in response to determining that the amount of time from the start of the voltage transition reaches the predetermined temporal threshold.

Example 20: The non-transitory computer-readable medium according to Example 19, wherein the set of operations further includes retrieving an estimated amount of time from the start of the voltage transition to a beginning of a decrease in the voltage that is output; and setting the estimated amount of time as the predetermined temporal threshold.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claims.

Accordingly, it is to be understood that the above description is intended to be illustrative and not restrictive. Many embodiments and applications other than the examples provided would be apparent upon reading the above description. The scope should be determined, not with reference to the above description, but should instead be determined with reference to the appended claims, along with the full scope of equivalents to which such claims are entitled. It is anticipated and intended that future developments will occur in the technologies discussed herein, and that the disclosed systems and methods will be incorporated into such future embodiments. In sum, it should be understood that the application is capable of modification and variation.

All terms used in the claims are intended to be given their broadest reasonable constructions and their ordinary meanings as understood by those knowledgeable in the technologies described herein unless an explicit indication to the contrary is made herein. In particular, use of the singular articles such as "a," "the," "said," etc. should be read to recite one or more of the indicated elements unless a claim recites an explicit limitation to the contrary.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

What is claimed is:

1. A system comprising:

a low-dropout regulator configured to generate a load current and output a voltage at an output node;

a digital-to-analog converter (DAC) configured to receive a control input, and output a DAC current to the low-dropout regulator based on the control input, wherein the DAC current is configured to modify the load current and mitigate an undershoot of the voltage that is output at the output node while the voltage transitions from a high voltage level to a low voltage level; and control circuitry configured to determine when the voltage transitions from the high voltage level to the low voltage level, determine when an amount of time from a start of the voltage transition reaches a predetermined temporal threshold in response to determining that the voltage is transitioning from the high voltage level to the low voltage level, and output the control input to the DAC in response to determining that the amount of time from the start of the voltage transition reaches the predetermined temporal threshold.

2. The system according to claim 1, wherein the control circuitry is further configured to retrieve an estimated amount of time from the start of the voltage transition to a beginning of a decrease in the voltage that is output, and set the estimated amount of time as the predetermined temporal threshold.

3. The system according to claim 1, wherein the control circuitry is further configured to retrieve an estimated amount of time from the start of the voltage transition to just before an end of the voltage transition, and set the estimated amount of time as the predetermined temporal threshold.

4. The system according to claim 1, wherein the DAC is a logarithmic resistive digital-to-analog converter.

5. The system according to claim 4, wherein, to output the DAC current based on the control input, the logarithmic resistive digital-to-analog converter is configured to output the DAC current with current pulses based on the control input.

6. The system according to claim 5, wherein the DAC current is configured to modify the output of the load current to mitigate the undershoot of the voltage at the output node further includes the current pulses stepping the load current from 10 microamperes (μA) to 1 milliampere (mA).

7. The system according to claim 1, wherein the low-dropout regulator further includes a transistor, a differential amplifier including a reference input, a feedback input, and an output that is electrically connected to a gate of the transistor, a voltage divider including a first resistor, a second resistor, and a feedback node between the first resistor and the second resistor that is electrically connected to the feedback input, a load current source configured to generate the load current, and an external capacitor, wherein the transistor and the first resistor are electrically connected directly to a first node, wherein the load current source and the external capacitor are electrically connected directly to the output node, and wherein the DAC is electrically connected directly to a second node that is between and electrically connected to the first node and the output node.

8. A method comprising:

receiving, with a digital-to-analog converter (DAC), a control input;

outputting, with the DAC, a DAC current to a low-dropout regulator based on the control input, wherein the DAC current modifies a load current generated by the low-dropout regulator and mitigates an undershoot of a voltage that is output at an output node of the low-dropout regulator while the voltage transitions from a high voltage level to a low voltage level;

determining when the voltage transitions from the high voltage level to the low voltage level;

determining when an amount of time from a start of the voltage transition reaches a predetermined temporal threshold in response to determining that the voltage is transitioning from the high voltage level to the low voltage level; and outputting the control input to the DAC in response to determining that the amount of time from the start of the voltage transition reaches the predetermined temporal threshold.

9. The method according to claim 8, further comprising:

retrieving an estimated amount of time from the start of the voltage transition to a beginning of a decrease in the voltage that is output; and setting the estimated amount of time as the predetermined temporal threshold.

10. The method according to claim 8, further comprising:

retrieving an estimated amount of time from the start of the voltage transition to just before an end of the voltage transition; and setting the estimated amount of time as the predetermined temporal threshold.

11. The method according to claim 8, wherein outputting the DAC current based on the control input further includes outputting the DAC current with current pulses based on the control input.

12. A non-transitory computer-readable medium comprising instructions that, when executed by an electronic processor, cause the electronic processor to perform a set of operations comprising:

determining when a voltage that is output at an output node of a low-dropout regulator transitions from a high voltage level to a low voltage level; and controlling a digital-to-analog converter (DAC) to output a DAC current to a low-dropout regulator, wherein the DAC current modifies a load current generated by the low-dropout regulator and mitigates an undershoot of the voltage that is output at the output node of the low-dropout regulator while the voltage transitions from the high voltage level to the low voltage level;

determining when an amount of time from a start of the voltage transition reaches a predetermined temporal threshold; and controlling the DAC to output the DAC current in response to determining that the amount of time from the start of the voltage transition reaches the predetermined temporal threshold.

13. The non-transitory computer-readable medium according to claim 12, wherein the set of operations further includes retrieving an estimated amount of time from the start of the voltage transition to a beginning of a decrease in the voltage that is output; and setting the estimated amount of time as the predetermined temporal threshold.

* * * * *